US006833106B1

(12) United States Patent
Reufer et al.

(10) Patent No.: US 6,833,106 B1
(45) Date of Patent: Dec. 21, 2004

(54) COMPACT BLAST FURNACE INSTALLATION

(75) Inventors: Franz Reufer, Düsseldorf (DE); Wilhelm Müller, Bottrop (DE); Thomas Kaluza, Dinslaken (DE); Rainer Beermann, Schermbeck (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/914,344

(22) PCT Filed: Feb. 1, 2000

(86) PCT No.: PCT/EP00/00808

§ 371 (c)(1),
(2), (4) Date: Mar. 19, 2002

(87) PCT Pub. No.: WO00/52213

PCT Pub. Date: Sep. 8, 2000

(30) Foreign Application Priority Data

Feb. 26, 1999 (DE) ..... 199 08 709

(51) Int. Cl.[7] ..... C21B 7/08

(52) U.S. Cl. ..... 266/78; 266/142; 266/144; 266/198; 266/199

(58) Field of Search ..... 266/45, 78, 142, 266/144, 184, 198, 199, 197, 271

(56) References Cited

U.S. PATENT DOCUMENTS 3,623,717 A * 11/1971 Maloney et al. ..... 266/192
3,764,027 A * 10/1973 Tokarz ..... 414/202
4,003,558 A 1/1977 Elsasser et al.
4,057,234 A * 11/1977 Brucher et al. ..... 266/272
4,670,049 A * 6/1987 Kelmar ..... 75/464

FOREIGN PATENT DOCUMENTS

DE 2338047 3/1975
DE 2542882 3/1977

OTHER PUBLICATIONS

Patent Abstracts of Japan, vol. 005, No. 024 (C–043), Feb. 13, 1981 & JP 55 152114 A (Kawasaki Steel Corp), Nov. 27, 1980.

Patent Abstracts of Japan, vol. 007, No. 259 (C–195), Nov. 18, 1983 & JP 58 141310 A (Shin Nippon Seitetsu KK), Aug. 22, 1983.

Avdeev V A et al: "New Technical Solutions in Blast–Furnace Designs" London Bd. 26, No. 4, Jan. 1, 1996, PP 26–31.

* cited by examiner

*Primary Examiner*—Melvyn Andrews
(74) *Attorney, Agent, or Firm*—Friedrich Kueffner

(57) ABSTRACT

In order to design a blast furnace in a space and cost-saving manner, the invention provides for an especially compact blast furnace (10) having no hearth, wherein the burden is transported to the charging platform by vertical conveyers (20) and a compactly designed burdening (30) and pouring bay (50) are placed in the immediate proximity of said installation.

6 Claims, 4 Drawing Sheets

60
31
32
56
40
41
20
52
50
10
18
26
25
54
55

COMPACT BLAST FURNACE INSTALLATION

BACKGROUND OF THE INVENTION

The invention relates to a blast furnace installation comprising a blast furnace of a shaft furnace construction and of a free-standing configuration without frame as well as correlated installation parts such as hot blast generating device, burdening, and pouring bay for continuous smelting of at least partially treated iron ore to hot metal.

Such blast furnaces without frame are known. For example, such blast furnaces without frame (American configuration) are described in "Httte", Taschenbuch für Eisenhüttenleute, publishing house Wilhelm Ernst & Sohn, Berlin, 1961, on page 528, wherein the shaft is armored with a steel sheet mantle and is supported by means of a support ring on supports which are positioned closely adjacent to the blast furnace.

Modern blast furnace installation technology is based on the design and an installation arrangement which is based on the available technology and the logistic necessities for charging of the blast furnace with raw materials as well as for transporting the liquid products hot metal and slag.

The generally available technology results in a blast furnace which is provided with a blast furnace frame in order to free the furnace construction itself as much as possible from all loads. On this blast furnace frame, the entire upper furnace construction, including top closing device, gas removal pipes, and safety valves inclusive of pressure compensation, is supported as well as the charging belt by which the raw materials are transported to the upper end of the blast furnace—the charging platform.

The blast furnace installation of known installations includes, in addition to the blast furnace, a burdening apparatus containing a burdening or mixture of ores (hereinafter referred to simply as "a burdening" or "the burdening"), which is connected with the blast furnace by a charging belt and, corresponding to the incline angle of the charging belt and the height of the blast furnace, approximately 55 to 65 m, is arranged approximately 300 m away from the blast furnace. Moreover, adjacent to the blast furnace a hot blast generating device is provided in which, by means of currently usually three hot blast apparatus, the required reaction gas (combustion air) is pre-heated as well as, furthermore, a dust removal and cleaning device for the blast furnace gas in the vicinity of the blast furnace. The frame armor of the blast furnace is cooled generally by means of a conventional frame open-surface cooler also known as a trickling apparatus.

In an unpublished German patent application (application No. 198 24 367.7) it has been suggested to replace the inclined elevator or the charging belt for the transport of the raw materials to the charging platform by a vertical elevator, and in a further unpublished application (application No. 198 16 867.5) it has been recommended to manufacture the water-cooled cooling elements, arranged between the frame armor and the refractory blast furnace wall, of a material having high thermal conductivity in order to minimize the danger of break-out within the frame area during operation of the blast furnace.

SUMMARY OF THE INVENTION

Based on this known prior art, it is the object of the invention to develop for a blast furnace a new space-saving and cost-saving concept of a blast furnace installation by which the crude steel production is economical even for small throughput.

This object is solved for a blast furnace installation wherein the blast furnace with a frame diameter of between 5 and 10 m is of a compact configuration with the features:

(a) a self-supporting blast furnace armor construction wherein the entire upper blast furnace construction of the blast furnace—with a top closing device configured as a revolving chute with a fixedly installed slant angle without tilting mechanism, gas removal pipe, and safety valves including pressure compensation—is supported on the blast furnace armor;

b) in the frame area, in the zones of belly of the blast furnace, waist of the blast furnace, and lower shaft, water-cooled cooling elements of a material having high thermal conductivity are arranged between the refractory furnace wall and the blast furnace armor; and c) for tapping of the hot metal only one tap hole is installed on the furnace with only one set of tap hole plugging and drilling machines.

With the measures of the invention, to configure the blast furnace in a compact configuration as well as to configure or arrange the arrangement of the most important installation parts belonging to the blast furnace in a compact way in direct vicinity of the blast furnace, a completely new design of a compact blast furnace installation is obtained. There is the possibility of installing a conventional frame open-surface cooler or trickling apparatus.

By employing cooling elements in the thermally highly loaded frame area of the blast furnace, which elements are manufactured of a material having high thermal conductivity, the blast furnace armor is optimally cooled in this area which is at risk for break-out. The danger of cooling failure with local overheating, in connection with failure of the material strength, is therefore no longer present. This results directly in that the blast furnace armor is particularly loaded and the complex blast furnace frame that was required in the past can be eliminated in any case. Required working platforms can be fastened directly on the armor of the furnace. Also, the entire upper furnace construction with a top closing device, gas removal pipes, and the safety valves including pressure compensation are now supported on the blast furnace armor.

According to an advantageous configuration of the invention, in this connections the otherwise conventional complex top closing device is formed by a revolving chute of a simplified configuration wherein a tilting mechanism is eliminated and the slant angle of the revolving chute is fixedly adjusted once according to the furnace size. This has the advantage, in particular, in the case of smaller blast furnaces, that the top closing device drive (the revolving chute carrier) can be constructed in a much simpler way and the material distribution can be controlled with the radially movable throat armor that is present.

Moreover, the support of a charging belt on the blast furnace or on the blast furnace frame is no longer required with the configuration of the compact blast furnace according to the invention because the charging belt is replaced by a vertical conveyor which does not require any supporting action and which is arranged directly adjacent to the blast furnace. The spacing of the vertical conveyor is approximately 25 to 35 m away from the center axis of the blast furnace. This makes it possible to arrange the burdening directly adjacent thereto—it is conventional in known blast furnace installations to have a spacing of the burdening housing from the blast furnace of approximately 300 m—so that a considerable savings in regard to the space requirement for the blast furnace arrangement according to the invention is obtained.

Also, the burdening itself is advantageously of a more compact design in that the working and material storage volume of 10 to 12 hours, conventional according to the prior art, is preferably reduced to 3 to 4 hours. This is sufficient for a safe consumption supply of the installation because the operation, as a result of the installed automation and control, is optimally monitored.

Since on the blast furnace only one tap hole aperture is installed (with only one set of tap hole plugging and drilling machines), it is now advantageously possible to design the pouring bay configuration much smaller (more compact) and thus in a more cost-beneficial way. The pouring bay, according to the invention, is arranged directly adjacent to the blast furnace and is configured such that the rail system for transporting the hot metal and liquid slag is no longer needed. By means of a gutter system the hot metal is transported into correspondingly large ladles and transported in a wheel-bound container, while the liquid slag is transported into a slag blanket and/or into a slag granulation apparatus.

With the hot blast generating device installed according to the invention with preferably only two hot blast apparatus, there is the possibility to configure the blast furnace installation in an even more space-saving and more compact way. In this connection, the installed automation and control device than ensures that, for example, the blast furnace installation can be operated with an annual production of approximately one million tons of hot metal in an optimal and extremely cost-beneficial way.

The construction of a compact blast furnace in connection with a compact burdening, a compact pouring bay (and its compact arrangement in direct vicinity of the blast furnace made possible by the use of the vertical conveyor) provides in this combination a technically totally new blast furnace installation which contributes considerably to the cost reduction of a modern steel making installation to be operated safely.

In particular, the compact blast furnace installation configured accordingly can be used for so-called mini mills. These are mini steel works with an annual capacity of approximately 0.5 to 2 million tons of crude steel. In such mini mills which are operated currently on the basis of direct reduction and/or melting of scrap metal by electric arc furnaces (EAF) and, as a result of their increased flexibility and economic benefits, have gained importance, a compact blast furnace device, as suggested by the invention, could be used advantageously.

Further details, features, and advantages of the invention will be explained in more detail in the following by means of the embodiments schematically illustrated in the drawings.

BRIEF DESCRIPTION OF THE DRAWING

It is shown in.

DETAILED DESCRIPTION OF THE INVENTION

Figure 1:
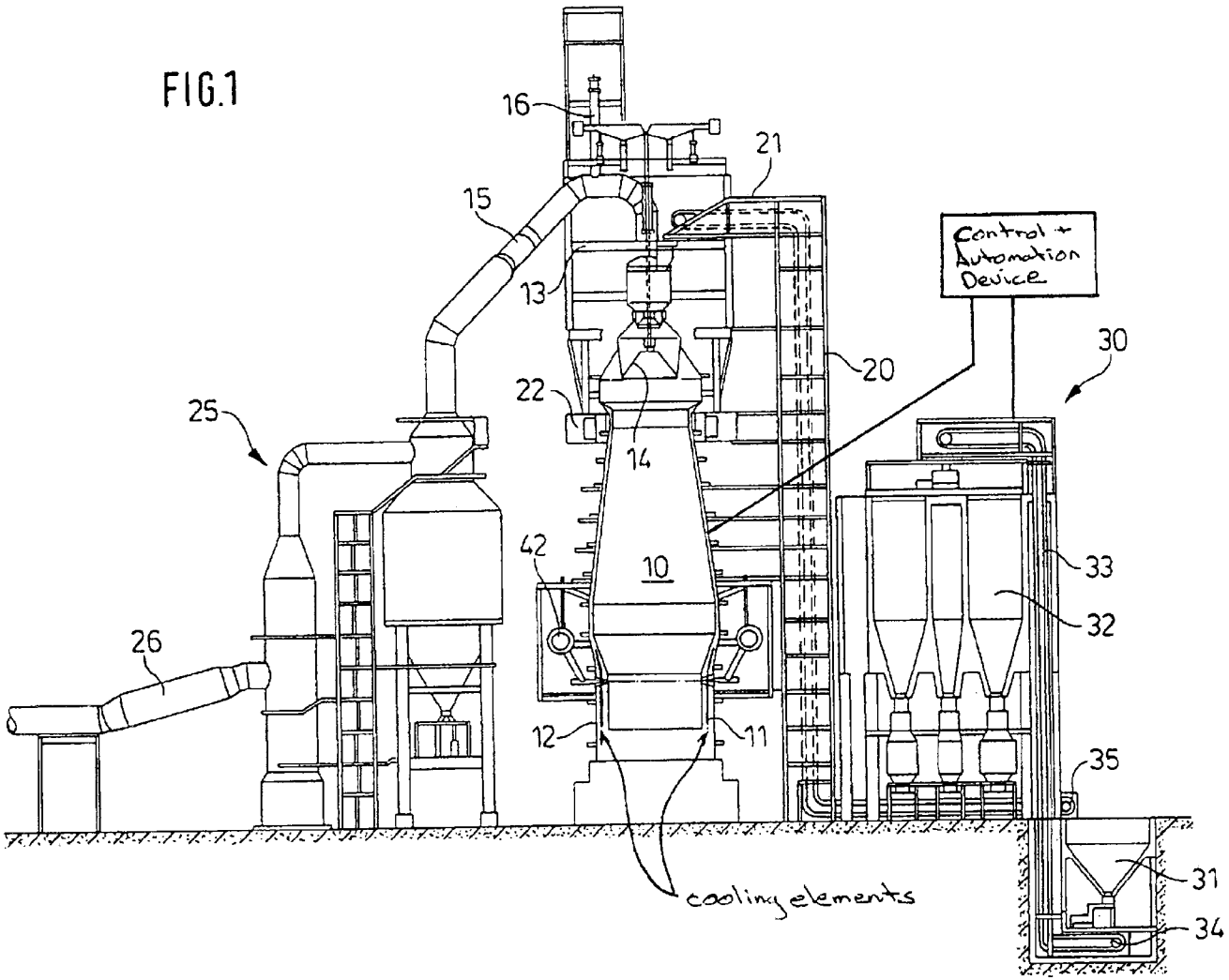
FIG. 1 a side view of a part of a compact blast furnace installation.
Figure 2:
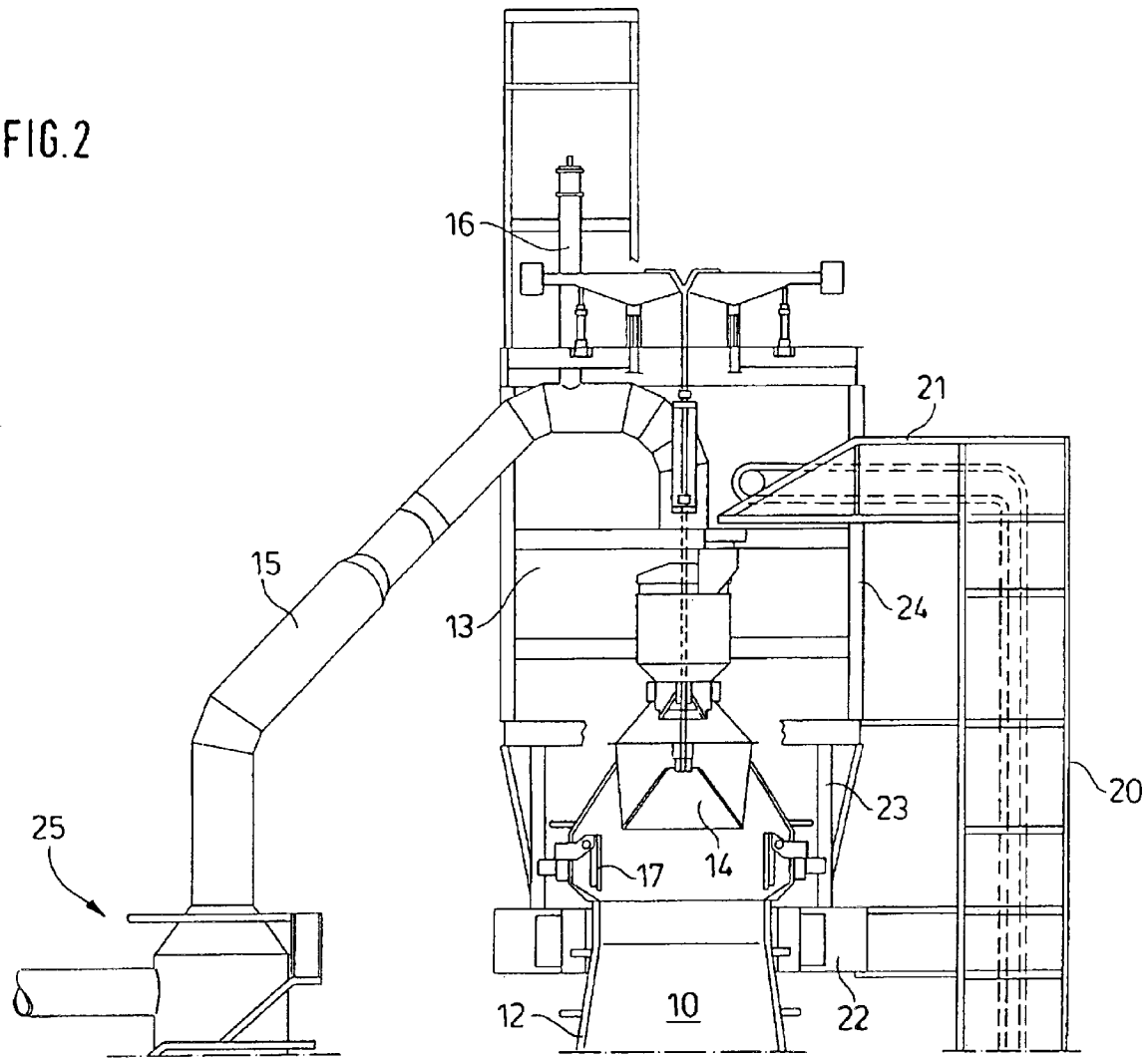
FIG. 2 an enlarged detail view of the top part of the blast furnace according to FIG. 1.

In FIGS. 1 and 2 a part of a compact blast furnace installation with blast furnace 10 is illustrated in a side view. Between the refractory furnace wall 11 and the blast furnace armor 12 watercooled cooling elements (not illustrated) are arranged so that the blast furnace, frame which is conventionally used otherwise for reasons of operational safety, is no longer needed, for which reason the loads, which would have to be supported otherwise on this frame, is completely taken up by the supports 23, 24 (FIG. 2) and the support ring 22 of the blast furnace armor 12. These loads are the entire upper furnace constructions with the top closing device 14, gas removal pipe 15, safety valve 16, and movable throat armor (FIG. 2) as well as the upper end 21 of the vertical conveyor 20 which is arranged directly adjacent to the blast furnace 10 at a spacing from the center axis of the blast furnace within approximately 25 to 35 m therefrom. By using a vertical conveyor 20 instead of a charging belt for transporting the raw materials to the charging platform 13, it is possible to arrange the burdening 30 in immediate vicinity of the blast furnace 10.

In addition to the compact arrangement of the burdening 30 immediately adjacent to the blast furnace 10, the burdening is of a compact and space-saving and room-saving configuration because it must provide only a working and material storage volume of up to 3 to 4 hours. It is comprised, for example, of underground hoppers 31 that can be filled from above with the raw materials by means of trucks, wherein this raw materials can be removed again therefrom by means of conveyer belts 34 and can be filled by means of a vertical conveyor 33 for the burdening into the elevated hoppers 32. By means of removal belts 35 and the vertical conveyor 20 these raw materials are then transported to the charging platform 13 of the blast furnace 10.

Figure 4:
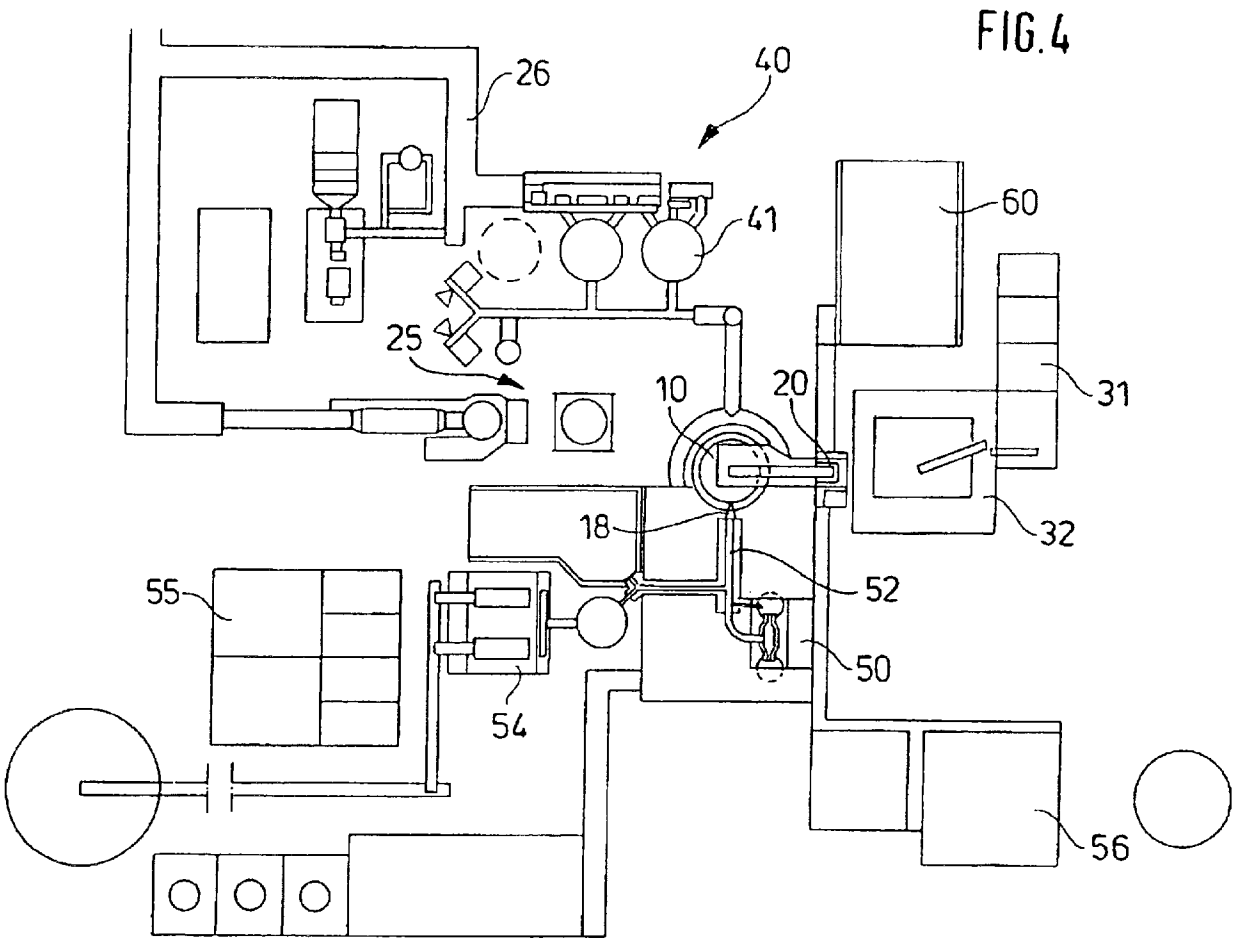
FIG. 4 a layout of a compact blast furnace installation in a schematic plan view.

Also in immediate vicinity of the blast furnace 10 and connected thereto by means of a gas removal pipe 15, a dust removal and cleaning device 25 for the blast furnace gas is provided from where a partial volume of the cleaned blast furnace gas is then guided by a pipeline 26 into the hot blast generating device 40 (FIG. 4).

In FIG. 2, the upper part of the blast furnace 10 is shown in an enlarged detail illustration. As a result of the larger scale, the upper furnace construction supported on the blast furnace armor 12 with the support ring 22 and the supports 23, 24 is shown better wherein which the upper end 21 of the vertical conveyor 20, the gas removal pipe 15 as well as the safety valve 16 are safely supported thereon. Moreover, in FIG. 2 the top closing device 14, which in the illustrated embodiment is a bell-type top, as well as the movable throat armor 17 are more clearly illustrated.

Figure 3:
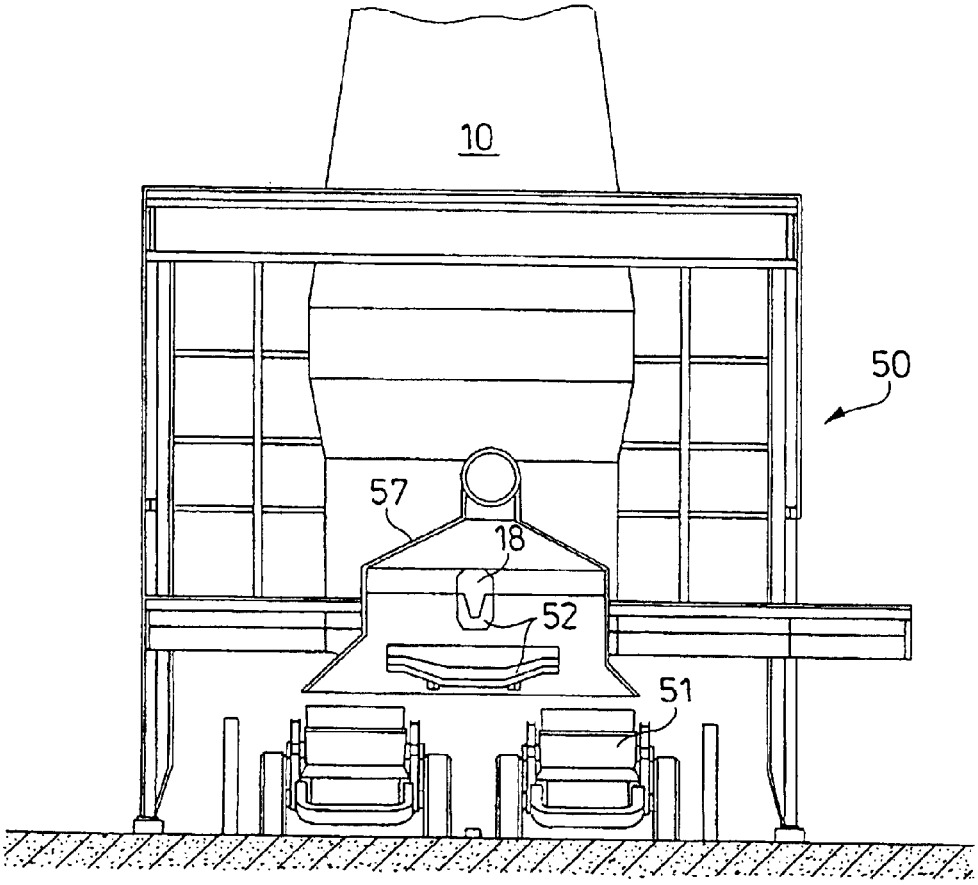
FIG. 3 an enlarged detail view of the lower part of the blast furnace with pouring bay according to FIG. 1, rotated by 90°.

In FIG. 3 there is illustrated, also on a scale slightly larger than that of FIG. 1, the lower part of the blast furnace 10. It shows schematically the tap hole 18 and the pouring bay 50 with the gutter system 52 via which the hot metal flows with natural gradient into the wheel-bound pouring ladles 51. Above the gutter system 52, a removal hood 57 is provided which is connected to a dust removal device 56 (FIG. 4) so that rising vapors curing tapping can be collected and disposed of in an environmentally safe way.

FIG. 4 shows the layout of the compact blast furnace installation according to the invention with its most important installation parts. The core of the installation is the blast furnace 10 about which the most important further installation parts for the operation of the blast furnace are positioned with a spacing as minimal as possible. As already described in connection with FIG. 1, in immediate vicinity of the blast furnace the burdening 30 with the underground hoppers 31 and the elevated hoppers 32, from which the blast furnace 10 is charged with the required raw materials via the vertical conveyor 20, are located.

The pouring bay 50 with the gutter system 52 is arranged also in direct vicinity of the blast furnace 10 via which the produced hot metal is transported into the pouring ladles 51 (FIG. 3) and the slag as a slag blanket or layer and/or into the slag granulation device 54. A water treatment plant 55 for providing the granulation water is arranged adjacent to the slag granulation device 54. The dust removal device 56 arranged adjacent to the pouring bay 50 is connected with the pouring bay 50 and the burdening 30 and provides during operation of the blast furnace 10 a proper dust removal of the pouring bay 50 and of the burdening 30.

The required hot blast for the operation of the blast furnace 10, which is introduced via the tuyeres 42 (FIG. 1) into the lower part of the blast furnace, is generated in hot blast generating device 40, also arranged in the vicinity of the hot blast furnace, in preferably two hot blast apparatus 41. The thermal energy which is required for operation of the hot blast generating device 40 is partially provided by the blast furnace gas which has been subjected to dust removal and cleaning. For this purpose, the blast furnace gas, which has been cleaned in the dust removal and cleaning device 25 for the blast furnace gas, is made available via a pipeline 26 to the hot blast generating device 40.

A further component of the compact blast furnace device according to the invention is finally a control room 60 from where, by means of the installed automation and control device, the operation of the blast furnace is monitored and controlled.

The embodiments of the compact blast furnace device illustrated in the drawings, in particular, the arrangement of the installation parts in the layout of FIG. 4, are only possible embodiments of the invention. They can be correspondingly modified, of course, according to the requirements and the specific local conditions when the features of the invention as they are formulated are complied with.

What is claimed is:

1. Blast furnace installation, comprising: a blast furnace in a shaft furnace configuration and of a free-standing construction; a hot blast generating device; a burdening; and a pouring bay, for continuous smelting of at least partially treated iron ore to hot metal, the blast furnace (10) having a frame diameter of between 5 and 10 m and the features:

(a) a self-supporting blast furnace armor construction wherein an entire upper blast furnace construction of the blast furnace (10) is supported on the blast furnace armor (12), the upper blast furnace construction including a top closing device (14) configured as a revolving chute with a fixedly installed slant angle without tilting mechanism and in working connection with a radially movable throat armor (17) arranged at a throat of the blast furnace, a gas removal pipe (15), and safety valves (16) including pressure compensation;

b) in a region of the frame, in zones of a belly of the blast furnace, a waist of the blast furnace, and a lower shaft, water-cooled cooling elements of a material having high thermal conductivity are arranged between the refractory furnace wall (11) and the blast furnace armor (12);

c) for tapping of the hot metal only one tap hole (18) is installed on the furnace (10).

2. Blast furnace installation according to claim 1, wherein a vertical conveyor (20) for conveying the raw materials into the blast furnace is arranged directly adjacent to the blast furnace (10), at a spacing from a center axis of the blast furnace of substantially 25 to 35 m, and the burdening (30) is arranged directly adjacent to the vertical conveyor (20).

3. Blast furnace installation according to claim 2, wherein the burdening (30) has a working and material storage volume of 3 to 4 hours.

4. Blast furnace installation according to claim 1, wherein the blast furnace (10) and the burdening (30) are connected to one another via an automation and control device.

5. Blast furnace installation according to claim 1, wherein the pouring bay (50) is configured and arranged directly adjacent to the blast furnace (10) such that by means of a gutter system (52) crude iron is directly transported into correspondingly large ladles (51) and slag is directly transported into at least one of a slag blanket (53) and a slag granulation device (54).

6. Blast furnace installation according to claim 1, wherein the hot blast generating device (40) includes only two hot blast apparatus (41).

* * * * *